US010926840B2

(12) United States Patent
van Dillen

(10) Patent No.: US 10,926,840 B2
(45) Date of Patent: Feb. 23, 2021

(54) INFLATABLE WATERCRAFT

(71) Applicant: Tiemen Tobias van Dillen, Moosburg (AT)

(72) Inventor: Tiemen Tobias van Dillen, Moosburg (AT)

( * ) Notice: Subject to any disclaimer, the term of this patent is extended or adjusted under 35 U.S.C. 154(b) by 78 days.

(21) Appl. No.: 16/093,625

(22) PCT Filed: Apr. 13, 2017

(86) PCT No.: PCT/EP2017/059023
§ 371 (c)(1),
(2) Date: Oct. 13, 2018

(87) PCT Pub. No.: WO2017/178628
PCT Pub. Date: Oct. 19, 2017

(65) Prior Publication Data

US 2019/0071150 A1 Mar. 7, 2019

Related U.S. Application Data

(60) Provisional application No. 62/322,047, filed on Apr. 13, 2016.

(51) Int. Cl.
*B63B 7/08* (2020.01)

(52) U.S. Cl.
CPC ..... *B63B 7/082* (2013.01)

(58) Field of Classification Search
CPC ..... A62C 33/04; B63B 7/08; B63B 7/082; B63B 34/22
See application file for complete search history.

(56) References Cited

U.S. PATENT DOCUMENTS

| | | | | |
|---|---|---|---|---|
| 3,168,751 | A * | 2/1965 | Cavaignac | B63B 7/082 114/345 |
| 7,509,920 | B2 * | 3/2009 | Taylor | B63B 59/02 114/343 |
| 2002/0083653 | A1 * | 7/2002 | Hilbert | E04H 15/20 52/2.17 |
| 2006/0096517 | A1 * | 5/2006 | Durand | B63B 7/082 114/345 |
| 2017/0088241 | A1 * | 3/2017 | Souter | B63B 34/56 |
| 2019/0374870 | A1 * | 12/2019 | Brezan | E04H 15/20 |

* cited by examiner

*Primary Examiner* — Andrew Polay

(57) ABSTRACT

An inflatable flotation chamber comprising a seamlessly constructed flexible tube, sealed ends, and a valve for inflation and deflation. Said chamber characterized in that it can be inflated to a relatively high pressure, giving functional shape and independent structural rigidness to the chamber.

A watercraft characterized by one or a multitude of such inflatable flotation chambers. A method of constructing such an inflatable flotation chamber.

20 Claims, 9 Drawing Sheets

INFLATABLE WATERCRAFT

CROSS-REFERENCE TO RELATED APPLICATIONS

This application claims the benefit of provisional patent application Ser. No. U.S. 62/322,047, filed 2016 Apr. 13, and PCT application Ser. No. PCT/EP2017/059023, filed 2017 Apr. 13 by the present inventor, which is incorporated by reference.

BACKGROUND OF THE DISCLOSURE

Field of the Invention

This invention relates generally to surface watercraft, and the construction thereof; though the operator may also be underwater.

Description of the Related Art

Inflatable watercraft are very popular for a variety of aquatic sports such as sailing, rowing, rafting, stand up paddle (SUP) boarding, and fishing. They are typically lightweight and easily portable, since the main flotation chambers can be deflated to make the craft more compact for transport. Various watercraft designs with inflatable flotation chambers even exist for larger motor boats.

A variety of designs and constructions means have been proposed in the past for the inflatable flotation elements. Some are relatively low cost, with a thin plastic membrane that is cut from flat material and then glued or heat fused together. Since the material is relatively thin, they are not very durable and highly susceptible to puncture by rocks or hooks. Some designs will use secondary covering of more robust, but porous material that is sewn together in the same shape as inner air tight flotation element. The second, porous covering results in very poor behavior of the watercraft in the water though, and the inflation pressure is still limited due to the glued/welded seams of the interior bladder and sewn seams of the outer bladder.

More durable watercraft for sailing, rafting, SUP boarding, and motor boarding, are also designed and constructed from a thicker, multi-layered material such as PVC or Hypalon, and again glued or heat fused together. Though they are more robust, the construction process involves a lot of manual effort and expertise, with the seams typically double, triple, or even quadruple overlapped for the right strength, quality assurance, and durability. Even in this case, the pressure used is still typically 1 bar or less. A sufficiently high pressure is needed to make the inflatable sufficiently stiff and ensure good behavior of the watercraft in the water, but the low maximum pressure allowed by the construction means that the user has to be very careful when inflating with automated means (electric pump or other source of pressurized air). They also need to be aware of the temperature or barometric changes that can occur during use. A watercraft inflated in the afternoon, can cool in the evening and lose pressure and stiffness. Or a watercraft that is transported in the inflated state can exceed its maximum relative pressure when the user drives to a higher location with lower barometric pressure.

US2002148400A1 relates to a flexible fluid containment vessel for transporting and containing a large volume of fluid, particularly fluid having a density less than that of salt water, more particularly, fresh water, and the method of making the same.

GB2457737A relates to portable compression chambers.

U.S. Pat. No. 5,732,650A describes an Inflatable reinforced plastic pontoon for aquatic vehicles.

WO2014/168590 describes a tent with inflatable structure comprising a beam made of standard fire hose or other industrial seamless hose having outer textile braiding.

EP0810339A1 describes a device for forming an elongated roof construction, comprising a cover sheet and two or more flexible tubular inflatable suspension elements. The suspension elements are preferably made of fire hoses.

SUMMARY OF THE PRESENT DISCLOSURE

The aim of the present summary is to facilitate understanding of the present disclosure. The summary thus presents concepts and features of the present disclosure in a more simplified form and in looser terms than the detailed description below and should not be taken as limiting other portions of the present disclosure.

Loosely speaking, the present disclosure teaches, inter alia, a technical solution and construction procedure for an inflatable flotation chamber. The solution and construction are easy and economical, so that also relatively unskilled personnel can construct the flotation chamber with very reliable quality and durability. Furthermore, the solution and construction method yield a flotation chamber that can be pressurized to relatively high maximum pressures, so that a watercraft can be constructed that is very stiff with good behavior in the water, and is very robust to changes in temperatures or barometric pressures.

The technical solution and construction procedure loosely described above may be embodied in the form of an inflatable flotation chamber, comprising a seamlessly constructed flexible tube that is trimmed to the appropriate size for the watercraft, and sealed at its ends, and a valve, located either in the main body of the tube, or integrated at its ends.

The inflatable flotation chamber of the present disclosure is presented in a variety of different embodiments of solution and construction, as well as a variety of different embodiments of integration within a variety of watercraft. The particular embodiments of the solution and construction are not to be considered limiting. A variety of alternate designs or readily available components may be considered as appropriate for use. The particular embodiments of the integration within watercraft, or the watercraft presented are not to be considered limiting. A variety of alternate designs or readily available components may be considered for the integration and assembly within a frame or structure, and variety of alternate watercraft could make use of such an inflatable flotation chamber, including small personal watercrafts and large multi-person watercrafts, or non-person watercrafts & aquatic rafts or platforms. The diameter and length of the inflatable flotation chambers can be scaled to any available sizes of the seamlessly constructed flexible tubes, according to the purpose that the watercraft is intended for.

Preferably, the inflatable flotation chamber is a flotation pontoon.

Preferably, the inflatable flotation chamber comprises: a seamlessly constructed flexible tube; sealed ends; and a valve for inflation & deflation.

Preferably, the sealed ends are glued, welded, or fused sealed, and reinforced by mechanical means.

Preferably, the sealed ends are sealed only by the clamping force of the mechanical means.

Preferably, the mechanical means of reinforcement or clamping also include an attachment point for integrating the flotation chamber into a structural frame or watercraft.

Preferably, the mechanical means of reinforcement or clamping also include one or a multitude of angled flanges that are pushed upon by the pressure of the gas inside the chamber.

Preferably, the mechanical means of reinforcement or clamping also include one or a multitude of flanges or protrusions that provide a better hydrodynamic shape to the chamber's end.

Preferably, the mechanical means of reinforcement or clamping also incorporates a structural cross member of the frame of a watercraft.

Preferably, the mechanical means of reinforcement or clamping also reinforce or seal a second inflatable flotation chamber.

Preferably, the pressure of the gas inside the chamber and the resultant longitudinal force of the chamber's ends are used to provide a tensile force to fix in place structural or connecting members of a floating frame or watercraft.

Preferably, the pressure of the gas is greater than 1 Bar.

Preferably, the watercraft comprises one or a multitude of inflatable flotation chambers.

Preferably, the pressure of the inflation chamber is used to spread one or more flexible decks.

Preferably, the pressure of the inflation chamber is used to spread flexible wires, lines, chains, webbing, or other rigging means.

Preferably, the flexible deck or rigging means is used to position one, or a multitude of rigid decks.

Preferably, a method of constructing an inflatable flotation chamber, comprises: trimming a seamlessly constructed flexible tube to appropriate length, installing a valve, and sealing the ends of the tube.

Preferably, the ends are sealed by fixing mechanical clamping elements onto the ends of the tube.

Preferably the ends are sealed by crimping the mechanical clamping elements onto the ends of the tube.

Preferably, the ends are trimmed at some angle less than a right angle to the length of the tube.

Preferably, the ends are trimmed at an angle between 45 and 60 degrees to the length of the tube.

DETAILED DESCRIPTION

Figure 1:
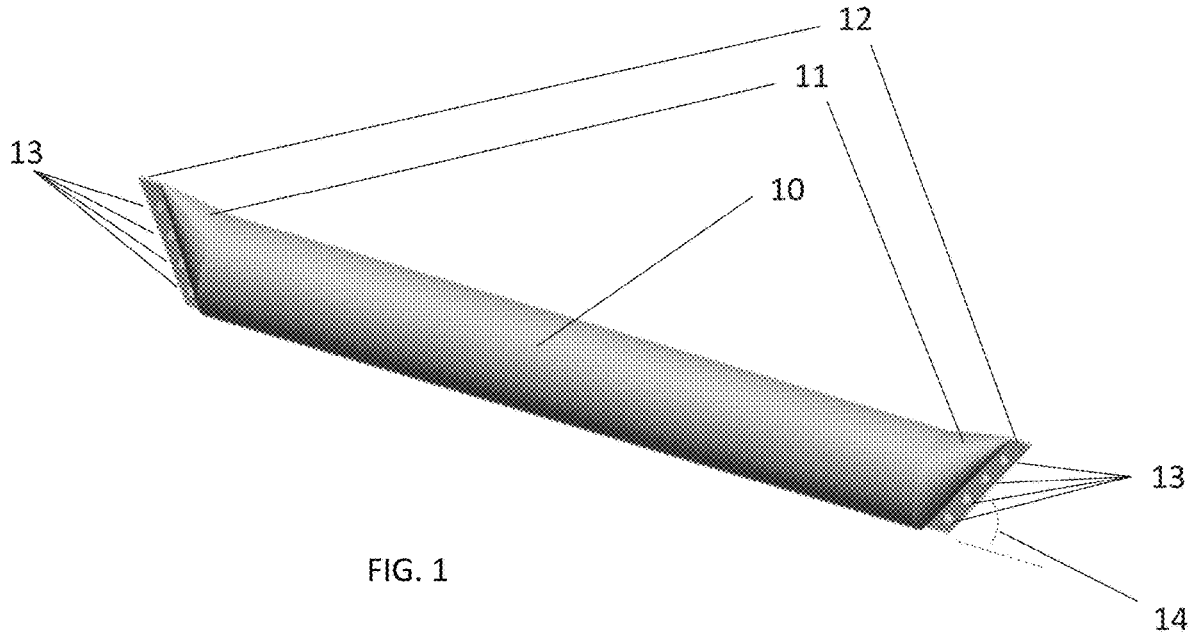
FIG. 1 shows an embodiment of a flotation chamber in accordance with the present disclosure.

The various embodiments of the present disclosure and of the claimed invention, in terms of both structure and operation, will be best understood from the following detailed description, especially when considered in conjunction with the accompanying drawings.

Before elucidating the embodiments shown in the Figures, various embodiments of the present disclosure will first be described in general terms.

As touched upon above, the present disclosure teaches a technical solution and construction procedure for an inflatable flotation chamber, comprising: a seamlessly constructed flexible tube that is trimmed to the appropriate size for the watercraft, and sealed at its ends, and a valve, located either in the main body of the tube, or integrated at its ends.

The seamlessly constructed flexible tube can be sourced from a variety of different materials and manufacturing means. A readily available, economical option is fire hose or agricultural irrigation hose. Such hoses are constructed with braided filament reinforcement, which makes them very flexible and able to withstand great pressure, for example pressures between 2 Bar and 10 Bar. With such inflation pressures, the hoses can be used in the present invention to form very structurally rigid flotation elements, which can ensure good behavior of the watercraft on the water. Also, the hoses are readily available in a variety of large diameters, allowing the same technical solution and construction procedure to be used for a variety of different sized watercraft. Typical diameters are 4, 6, 8, or 12 inch, with reel lengths of 50 or 100 m. A small watercraft or float may be constructed from 4-inch diameter hose trimmed to 80 cm, in the same procedure and way that a larger watercraft may be constructed from a 12-inch diameter hose trimmed to 8 m.

The seamlessly constructed tube may be simply trimmed straight, perpendicular to its length. It may also be trimmed in a variety of other means and designs, either aesthetic or functional. In a preferred means, the tube is trimmed with opposing angles. This gives a functional shape to the flotation chamber, that cuts through the water & waves. It also allows the opposing, upper tips to be used to provide significant longitudinal tension for an assembly frame or deck when the flotation chamber is inflated to full pressure. In the preferred embodiment, the angle is in the range of 45 to 60 degrees.

The trimmed ends may be sealed in a variety of ways. They may be glued or heat sealed, though this is not essential. If they are glued or heat sealed, the glued seam may be strengthened by a variety of mechanical means such as rivets, staples, or sewing. These mechanical means can be further used as attachment points in order to attach the flotation chamber to the frame of the watercraft. The trimmed ends may also be simply mechanically sealed by clamping the tube together, either flat on its own, or onto a separate formed end piece. The mechanical means can comprise a mechanical clamping means or end piece. The mechanical clamping elements or end piece can have further attachment points in order to attach the flotation chamber to the frame of the watercraft. Part of the frame may also be directly integrated into the clamping elements or end piece. The position and design of the frame connection may be such that it functionally uses the longitudinal tension provided by the inflated flotation chamber and angular trimmed ends. In one preferred form, for instance, a cross bar can be connected to the tips of the clamping elements, and a fabric deck spanned between the cross bars. When the flotation chamber is inflated to a high pressure, it provides a significant tension on the deck fabric to pull it taut. In an alternate preferred form, the clamping elements may have an attachment point for a series of webbings, ropes, or cables to connect to and rig and fix a central rigid deck or a plurality of frame elements.

The valve may be located on the body of the tube, or integrated into the ends. The valve could be any of a variety of standard air inlet or inflation valves. It may be a simple needle valve, or a tube that is capped or plugged, or it may have an integrated check valve mechanism. It may be glued or heat sealed to the flotation chamber, or it may be screwed on. It may be designed to fit within a deformation of the clamping elements, and thus clamped at the tube ends, or it may be incorporated into the separate end piece.

FIG. 1 shows an embodiment of a flotation chamber in accordance with the present disclosure, e.g. as described above. In particular, FIG. 1 shows an embodiment of an inflatable flotation chamber, made from a seamlessly constructed flexible tube (10) that has been trimmed to opposing angles at the ends (11). The angle (14) of the trimmed end (11) is in the range of 45 degrees to 60 degrees, as measured from the front with respect to the longitudinal direction. The ends (11) have been glued and pressed along a 20 mm wide border (12) to seal them, and the seal is further mechanically reinforced by a series of hollow rivets (13). Other means or reinforcement such as staples, stitching, solid rivets, or bolts may also be used. Though this embodiment does not show the further integration within a frame or watercraft, it should be understood that the hollow rivets (13), or alternative reinforcement, may also function as attachment points for such integration or fixation as will be shown by the alternate embodiments in this disclosure. A valve (not shown) may be integrated in the main body of the tube (10), or within the ends (11) or sealed border (12).

Figure 2A:
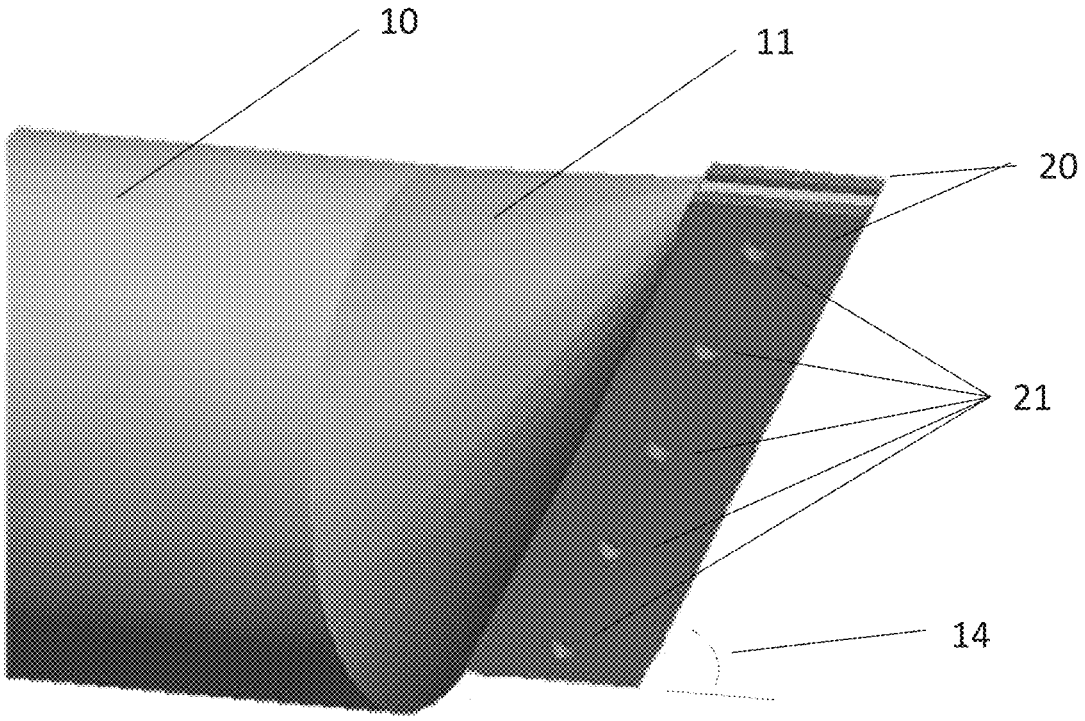
FIG. 2A shows another embodiment of a flotation chamber in accordance with the present disclosure.

FIG. 2A shows another embodiment of a flotation chamber in accordance with the present disclosure, e.g. as described above. In particular, FIG. 2A shows a close up view of the embodiment of an inflatable flotation chamber, made from a seamlessly constructed flexible tube (10) that has been trimmed to opposing angles at the ends (11). The angle (14) of the trimmed end (11) is in the range of 45 degrees to 60 degrees, as measured from the front from the longitudinal direction. The ends (11) are not glued or heat sealed, but instead mechanically sealed by clamping the tube (10) together using 2 clamping plates (20). The clamping plates (20) can be constructed from a variety of rigid materials, including plastic and metals. In this particular embodiment, it is constructed from marine grade aluminum. The end (11) and clamping plates (20) have a series of matching holes (21) through which a variety of fasteners (not pictured) such as rivets or bolts can be inserted and fastened to complete the mechanical assembly. The width of the clamping plates (20) can vary according to the strength of the material, the diameter of the tube, and the spacing and strength of the fasteners. In this example, for a 4-inch diameter tube, a clamping plate (20) 2 mm thick and 20 mm wide is shown, to be fixed by 5 bolts 4 mm in diameter. The clamping plate (20) does not have to be a simple straight strip. A variety of alternate shapes may be used, including curved or angular shaped plates, provided they extend sufficiently across the end (11) to fully seal it. The clamping plate (20) may also be divided into a multitude of segments, provided the segments are fixed in close enough proximity to each other to create a continuous seal across the end (11).

Figure 2B:
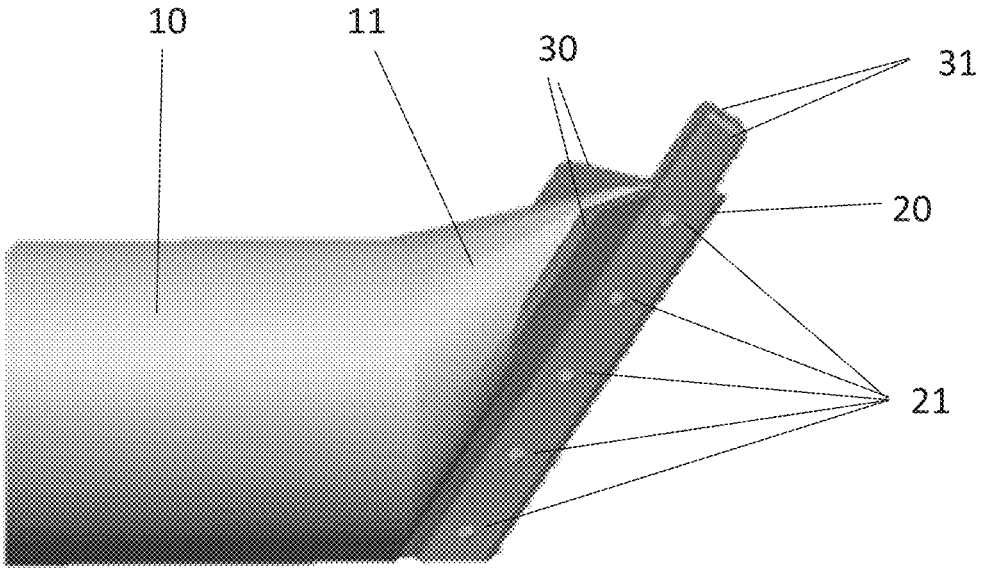
FIG. 2B shows another embodiment of a flotation chamber in accordance with the present disclosure. The inflated (10) is shown in its unrestricted form, overlapping the flanges (30). In reality, the rigid flanges (30) will actually push back and deform the shape of the tube wall.
Figure 2C:
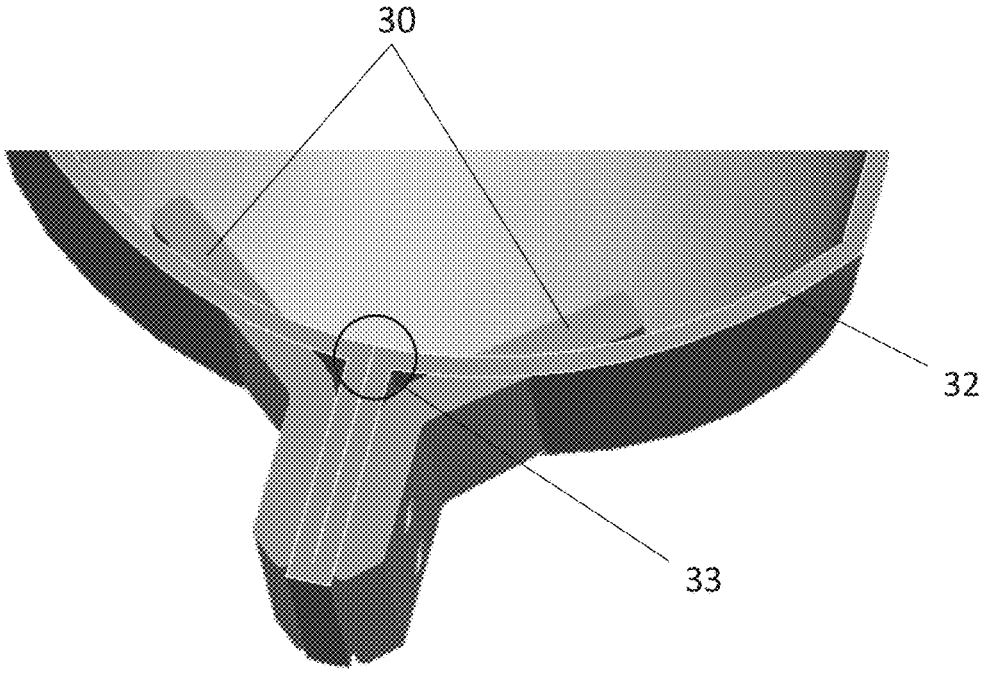
FIG. 2C shows a cross-sectional view of the embodiment of FIG. 2B. The inflated tube (10) is shown in its unrestricted form, overlapping the flanges (30). In reality, the rigid flanges (30) will actually push back and deform the shape of the tube wall.

FIGS. 2B and 2C show another embodiment of a flotation chamber in accordance with the present disclosure, e.g. as described above. In particular, FIG. 2B shows a close up view of an alternate design for the clamping plates (20), and FIG. 2C shows a cross sectional view of the same alternate design for the clamping plates (20). In this alternate design, the clamping plates (20) are cut to an engineered pattern, and then bent to create flanges (30) that can push back on the wall (32) of the tube (10). In this particular embodiment, the flanges (30) are full strips along the entire length of the clamping plates (20), but they could also be designed and bent as a partial strip or multitude of partial strips that push pack on just particular areas of the wall (32). In this particular embodiment, the flanges (30) are constructed from the same piece as the clamping plates (20), but they could also be separate pieces fixed together by fasteners through the series of matching holes (21).

FIGS. 2B and 2C show the inflated tube (10) in its unrestricted form, overlapping the flanges (30). It should be clear to a person of ordinary skill in the art that actually, the rigid flanges (30) will push back and deform the shape of the tube wall (32). In this way, the design and shape of the flanges (30) can be adjusted to push the tube end (11) into a more hydrodynamic shape. A second function of the flanges (30) is that the back pressure from the compressed air in the flotation chamber on the flanges (30) provides a significant stabilizing force to prevent the clamping plates (20) from bending along the seam (33), which allows for more rigid frame structures and integrations into various watercraft.

FIG. 2B also shows additional connection protrusions (31) on the top of the clamping plates (20). The function of these protrusions (31) will be explained in more detail in FIGS. 4A-4C.

Figure 2D:
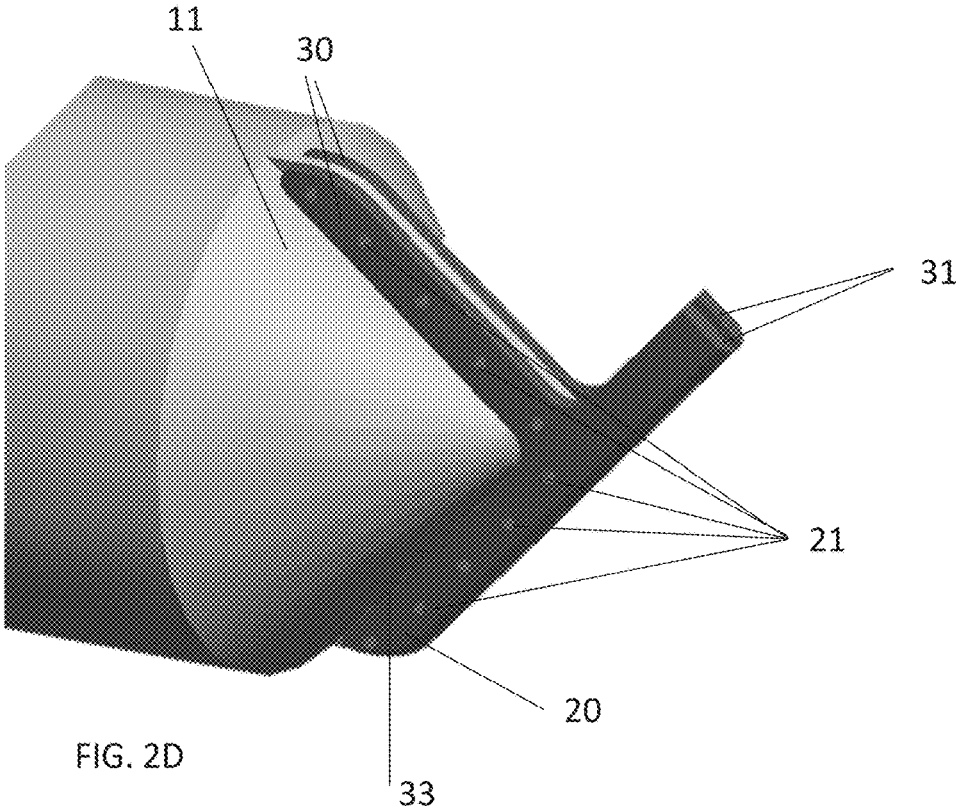
FIG. 2D shows another embodiment of a flotation chamber in accordance with the present disclosure.

FIG. 2D shows another embodiment of a flotation chamber in accordance with the present disclosure. It shows another alternate design of the clamping plates (20). This design can be cut flat, without extra bending, and uses an elongated flange (30) that is clamped together and also interacts with the pressure in the flotation chamber to keep the tube end (11) into a more hydrodynamic shape and provide a significant stabilizing force to prevent the clamping plates (20) from bending along the seam (33).

FIG. 2D also shows additional connection protrusions (31) on the top of the clamping plates (20). The function of these protrusions (31) will be explained in more detail in FIGS. 4A-4C.

Figure 3A:
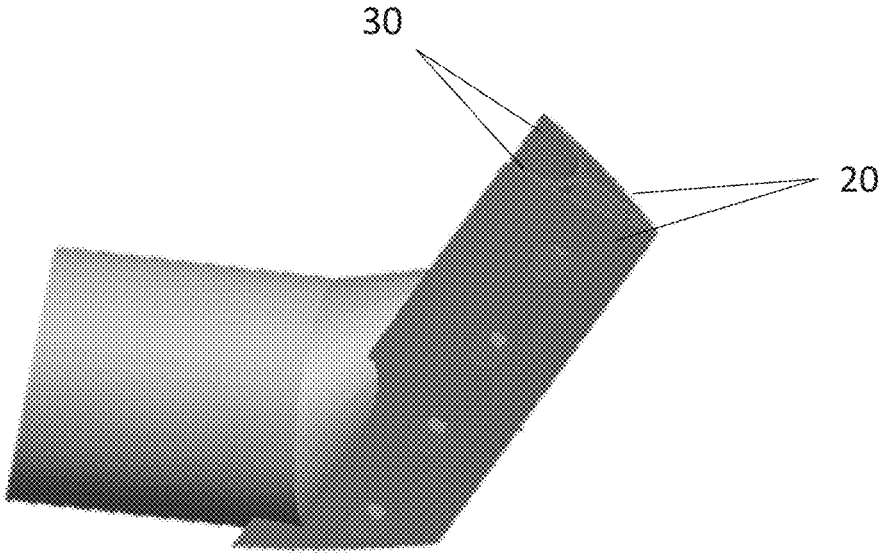
FIG. 3A shows an embodiments of a flotation chamber in accordance with the present disclosure. The inflated tube (10) is shown in its unrestricted form, overlapping the flanges (3). In reality, the rigid flanges (3) will actually push back and deform the shape of the tube wall.
Figure 3B:
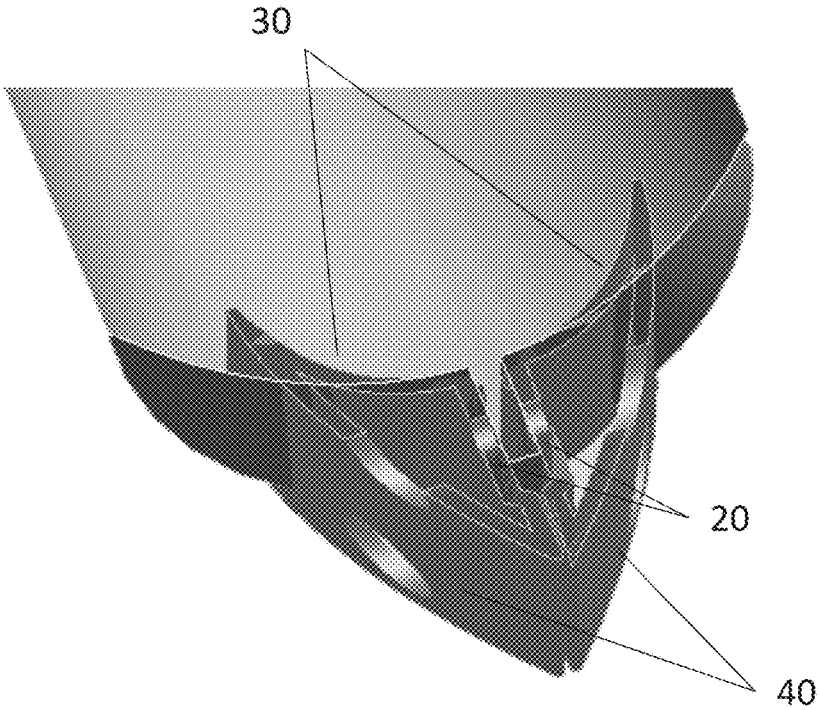
FIG. 3B shows a cross-sectinal view of the embodiment of FIG. 3A. The inflated tube (10) is shown in its unrestricted form, overlapping the flanges (30). In reality, the rigid flanges (30) will actually push back and deform the shape of the tube wall.

FIGS. 3A and 3B show another embodiment of a floation chamber in accordance with the present disclosure, e.g. as described above. The figures show the inflated tube (10) in its restricted form, overlapping the flanges (30). In reality, the rigid flanges (3) will actually push back and deform the shape of the tube wall. The interference is illustrated to indicate the outward push on the flanges (30) by the tubes trying to get into their natural, unrestricted form. In particular, FIG. 3A shows a close up view of an alternate design for the clamping plates (2), and FIG. 3B shows a 15 cross sectional view of the same alternate design for the clamping plates (20). In this alternate design, the clamping plates (20) are formed from extruded profile, which allows the hydrodynamic surfaces (40) to be separately optimized from the flanges (30).

Figure 3C:
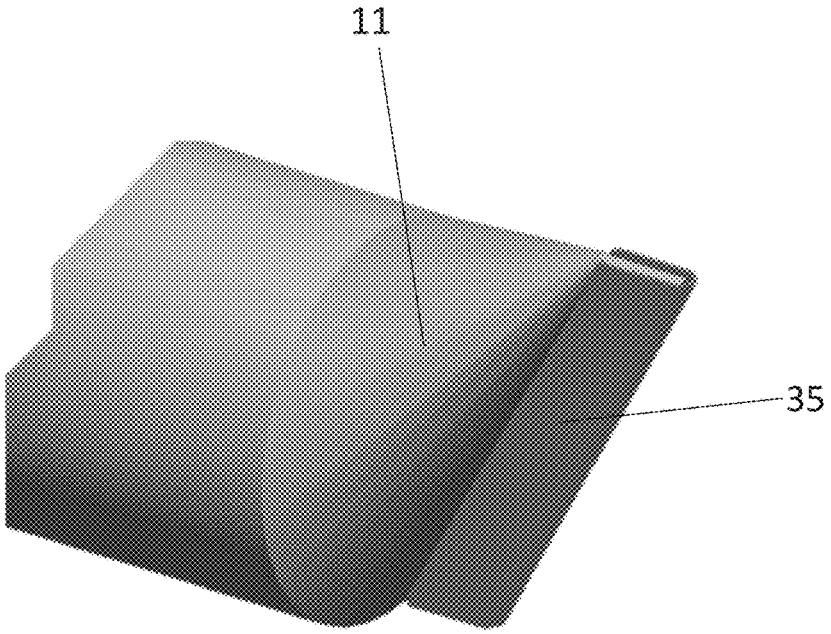
FIG. 3C shows another embodiment of a flotation chamber in accordance with the present disclosure.
Figure 3D:
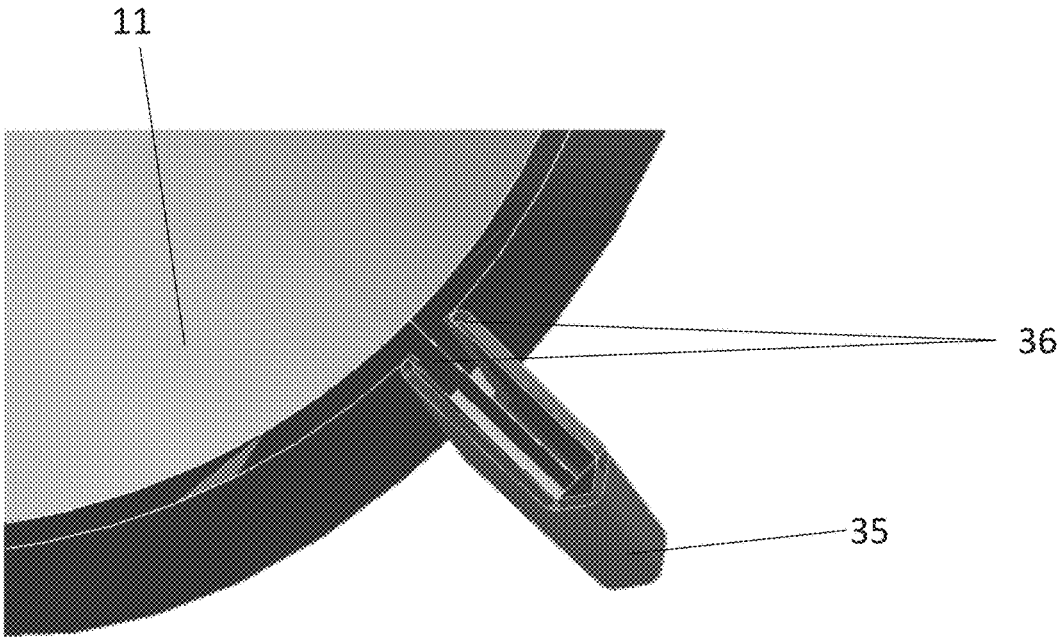
FIG. 3D shows a cross-sectional view of the embodiment of FIG. 3C.

FIGS. 3C and 3D show another embodiment of a flotation chamber in accordance with the present disclosure, e.g. as described above. In particular, FIG. 3C shows a close up view of an alternate design for mechanically clamping the ends (11) of the flotation chamber. It has a crimping strip (35) that is pressed or crimped onto the end (11) during production. The crimping strip (35) may be made from a variety of materials that are sufficiently strong and durable to maintain the clamping force, for instance aluminum or stainless steel. Rather than being crimped on, it may also be made from a material with a relatively high yield strength, spread open elastically for assembly with the tube end (11), and released to clamp the tube ends (11) by its own elastic/spring force. FIG. 3D shows a cross sectional view of the embodiment from FIG. 3C. It shows that the crimping strip (35) may also have some geometric features, edge, or teeth (36) that help concentrate the spring or crimping force across a uniform edge of the tube ends (11), or help avoid the crimping strip (35) being pushed off laterally.

The particular embodiments shown in FIGS. 1-3 are not to be considered limiting. A variety of alternate designs or readily available components may be considered as appropriate for use. In addition, a variety of alternate combinations of the described components may be used. For instance, two or more tubes (10) may be clamped or crimped, either end to end or in parallel, with a single set of clamping plates (20) or crimping strip (35).

Figure 5A:
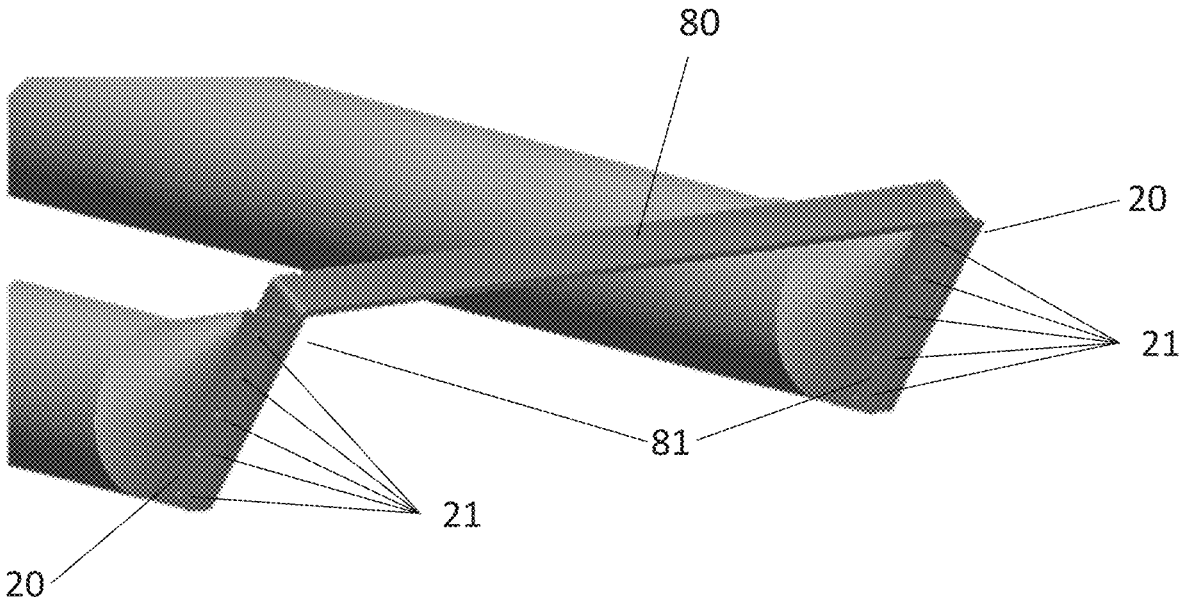
FIG. 5A shows an embodiment of an alternative frame integration incorporating flotation chambers in accordance with the present disclosure.
Figure 5B:
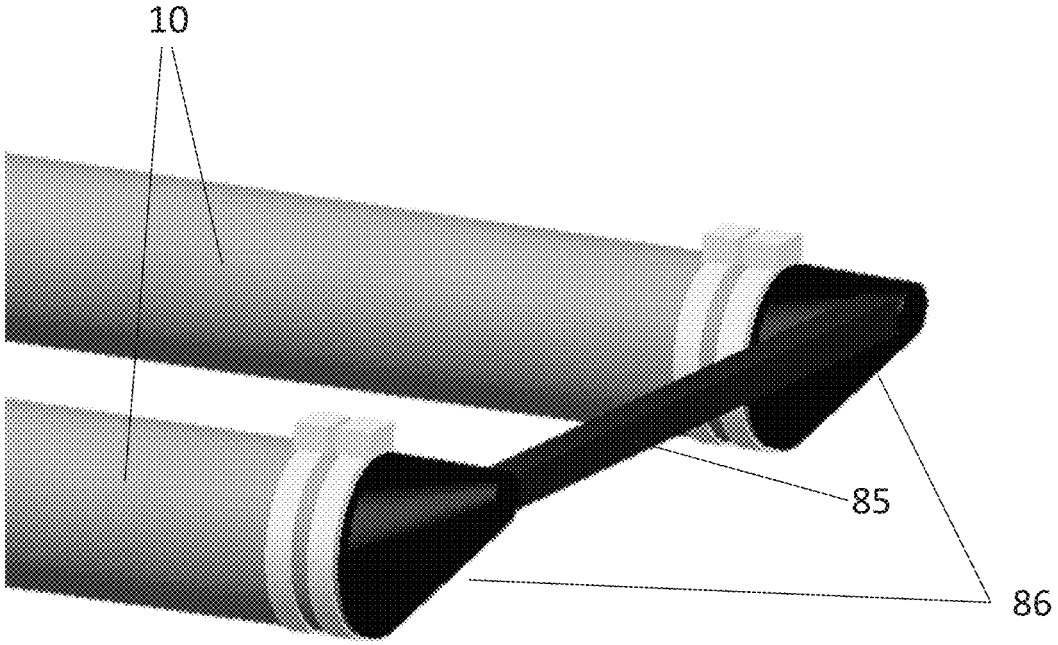
FIG. 5B shows another embodiment of an alternative frame integration incorporating flotation chambers in accordance with the present disclosure.
Figure 6:
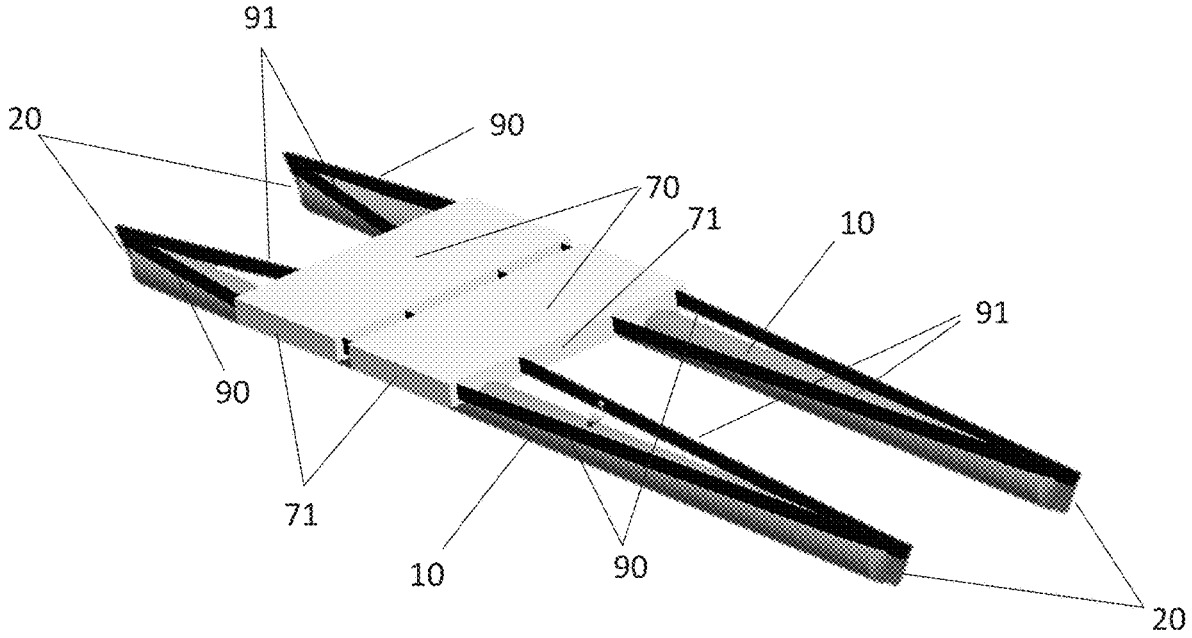
FIG. 6 shows another embodiment of a watercraft incorporating flotation chambers in accordance with the present disclosure.

FIGS. 4-6 will show a variety of watercraft and integration means for incorporating a variety of flotation chambers in accordance with the present disclosure. The figures, descriptions, and embodiments should not be construed as limiting. A variety of alternate combinations, fixation or integration means, or watercraft may be considered as appropriate for use.

Figure 4A:
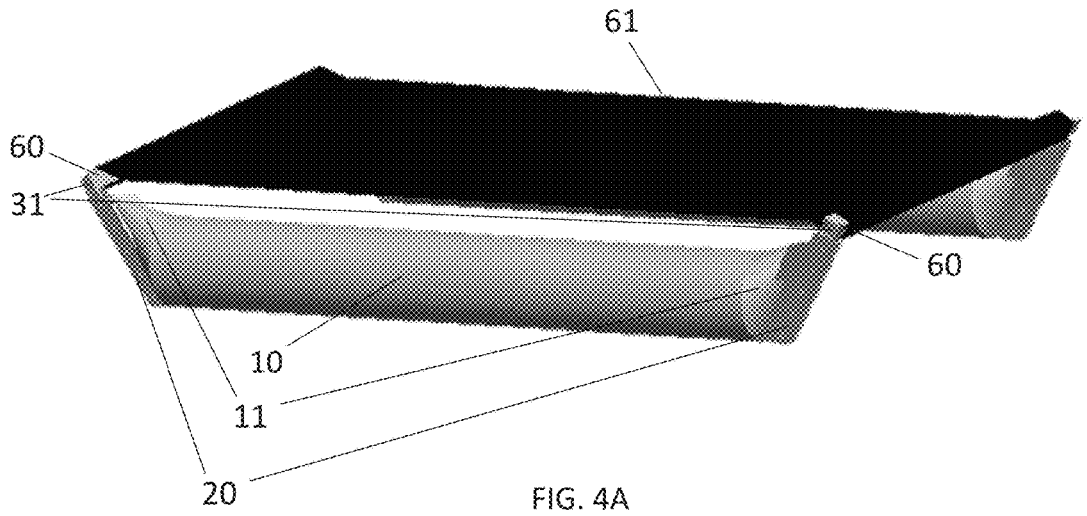
FIG. 4A shows an embodiment of a watercraft incorporating 2 flotation chambers as disclosed in the embodiment from FIGS. 2B and 2C.

FIG. 4A shows an embodiment of a watercraft incorporating 2 flotation chambers as disclosed in the embodiment from FIGS. 2B and 2C. The pressure of the air inside the inflated tube (10) is sufficiently high to provide outward force on the tube ends (11), clamping plates (20), and the connection protrusions (31). The connection protrusions (31) mate with a rigid crossbar (60), which transfer the outward force to the fabric deck (61) and creates a tension to pull it taut. In this particular embodiment, the watercraft is a small float with tubes (10) roughly 1 m long and 4 inch in diameter. The fabric deck is 2 or 3 cm shorter than the unrestricted distance between the connection protrusions (31). When assembled, the tube ends (11) are thus slightly restricted and bent and pressure exerted on them by the air inside creates a significant tension on the fabric deck (61). It should be noted that the connection point between the connection protrusions (31) and the crossbar (60) is shown in a simplified form in FIG. 4A. A variety of supporting fixation solutions including additional flanges, screws, or other fasteners may be used to ensure that the connection is sufficiently rigid for the intended purpose of the watercraft.

Figure 4B:
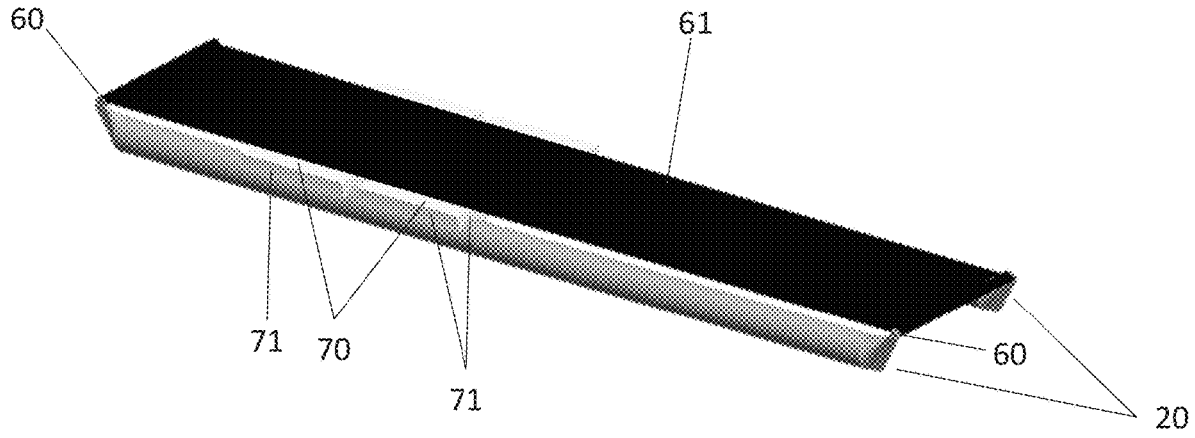
FIG. 4B shows another embodiment of a watercraft incorporating flotation chambers in accordance with the present disclosure.
Figure 4C:
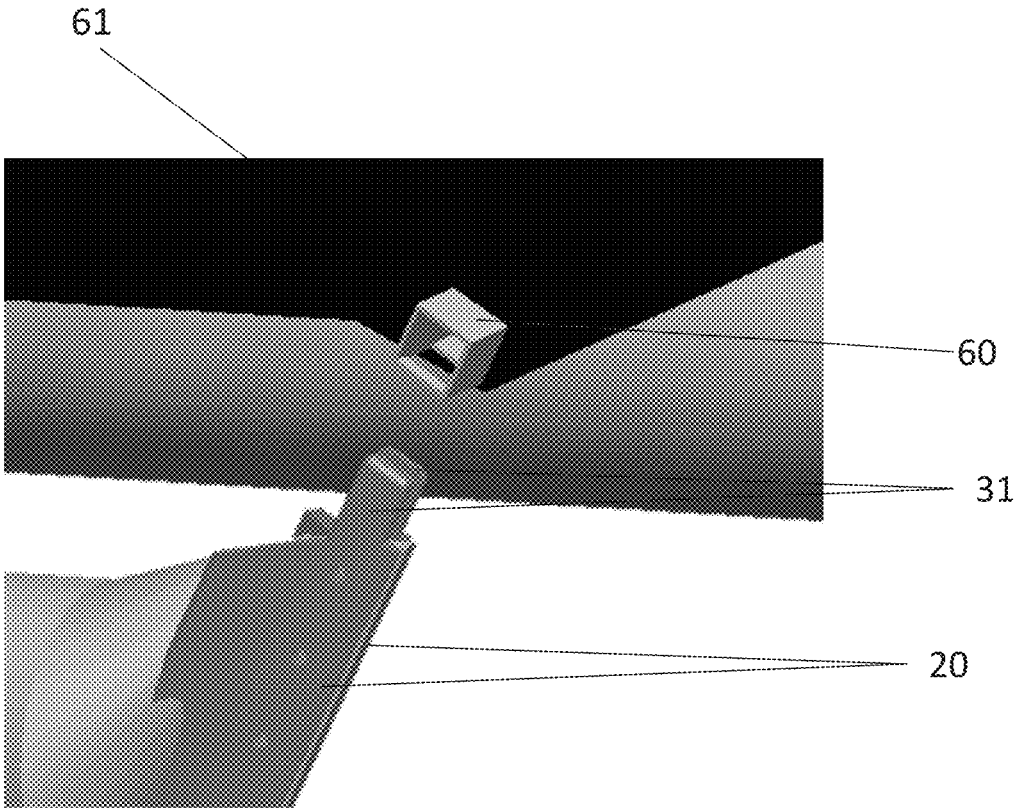
FIG. 4C shows a detail view of the embodiment of FIG. 4B.

FIGS. 4B and 4C show another embodiment of a watercraft incorporating flotation chambers in accordance with the present disclosure, e.g. as described above. In particular, FIG. 4B shows an assembled and inflated watercraft that may be used as a stand-up paddleboard, with tubes (10) that are around 3 or 4 m long and 4 inch in diameter, though different lengths and diameters may be used similarly. The watercraft has 2 inflated flotation chambers that spread a fabric deck (61) in a similar way as disclosed in the previous embodiment of FIG. 4A. In the current embodiment, however, the fabric deck (61) is further connected to a pair of rigid deck boards (70). The deck boards (70) may have protruding edges (71) all around its perimeter, to provide extra stiffness and fixation points, and to allow a secondary function for the deck boards (70) as a carrying case. When the tubes (10) are deflated, they can be folded up along with the fabric deck (61), and stored within the void created when the 2 deck boards (70) are placed against each other along their protruding edges (71). A variety of fixation solutions including webbing, hinges, clips, bolts, or other fasteners may be used in a variety of combinations to keep the 2 deck boards (70) together during transport. The watercraft may also have a plurality of additional, smaller rigid deck boards (not shown) that are similarly attached to the fabric deck (61) to expand the usable rigid surface area to stand on. These may also be stored within the carrying case created by the main deck boards (70). The watercraft may also be constructed with a single, larger deck board, and use the fabric deck (61) as the carrying case.

The deck boards (70) may simply rest on the tubes (10), or they may be attached to the tubes (10) in one of a variety of ways, including gluing, webbing around the diameter of the tubes (10), or other fixation means. This gives the watercraft a more rigid structure, while still allowing it to be folded up when deflated as described above. It also allows the crossbar (60) to be fixed to the clamping plate (20) in a simplified way, or left out entirely. FIG. 4C shows a close up of the simplified fixation in the case of the embodiment of FIG. 4B. In this case, the connection protrusions (31) can mate with the crossbar (60) in a simple pin & hole connection. Though not shown, a variety of alternate fixations and integrations could be used. For instance, the ends of the fabric deck (61) may also be attached directly to the connection protrusions (31). Alternatively, the clamping plates (20) with or without connection protrusions (31), may be used to span webbing, cable, or other means for rigging to fix rigid deck boards or a variety of other frame elements in a similar fashion.

FIG. 5A shows an embodiment of an alternative frame integration incorporating flotation chambers in accordance with the present disclosure, e.g. as described above. In this embodiment, an alternatively designed crossbar (80), directly integrates matching clamping plate surfaces (81), and a series of matching holes (21) through which a variety of fasteners (not pictured) such as rivets or bolts can be inserted and fastened to complete the mechanical assembly.

FIG. 5B shows another embodiment of an alternative frame integration incorporating flotation chambers in accordance with the present disclosure. In this embodiment, an alternatively designed crossbar (86), directly integrates formed end pieces (85), to which the tubes (11) can be clamped. The end pieces (85) may be hollow and sealed around the crossbar (86), which may also be hollow. In this way, a sealed air passage may be provided between the 2 tubes (11) and allow the entire watercraft to be inflated in a single operation through a single valve.

FIG. 6 shows another embodiment of an alternative frame integration incorporating flotation chambers in accordance with the present disclosure. It shows an assembled and inflated watercraft that may be used as a stand-up paddle-board, with tubes (10) that are around 3 or 4 m long and 4 inch in diameter, though different lengths and diameters may be used similarly. The watercraft has 2 inflated flotation chambers that spread a multitude of webbings (90) & (91) to connect to and rig and fix a pair of rigid deck boards (70). The deck boards (70) may have protruding edges (71) all around its perimeter, to provide extra stiffness and fixation points, and to allow a secondary function for the deck boards (70) as a carrying case, as described also in the embodiment of FIG. 4B. The pressure in the tubes (10) creates an outward force on the clamping plates (20). The webbings (90) & (91) may be attached together at the ends and loop around the tops of the clamping plates (20), and are pulled taut with considerable tension due to the high pressure that can be contained by the flotation chambers from the present disclosure. The webbings (90) & (91) may be attached in a variety of alternate ways, including through the use of bolts, rivets, stitching etc. as described in previous embodiments.

The webbings (90) & (91) are fixed to the deck boards (70) or the protruding edges (71) at some distance laterally from the center line of the tubes (10), to create rigidity in the overall structure of the watercraft. In the example shown, the distance of the outer 2 webbings (90) may be in the range of 5 to 20 cm from the center line of the of the tubes (10). Larger distances may also be possible, but require the deck boards (70) to be wider and protrude out further on the sides of the watercraft. The distance for the inner 2 webbings (91) may be in the range of 5 to 100 cm, potentially even reaching over to the other tube (10) and crossing over each other.

As described previously, the deck boards (70) may be designed in such a way that they can also function as the carrying case. A variety of other functionalities may be further incorporated into the deck boards (70) as well, including functioning as a housing for a battery and pump for inflation, or for a small electric propulsion means.

The watercraft may also have a plurality of additional, smaller rigid deck boards (not shown) that are similarly attached to the webbings (90) & (91) to expand the usable rigid surface area to stand on. These may also be stored within the carrying case created by the main deck boards (70). The watercraft may also be constructed with a single, larger deck board.

What is claimed is:

1. An inflatable flotation chamber for a watercraft, comprising:

at least one flexible tube made of a standard fire hose or other industrial or agricultural seamless hose having a braided filament reinforcement, resistant to a relatively high pressures in excess of 200 kPa, the tube having a main body and sealed ends, wherein at least the front end of the tube is trimmed at an angle, thereby giving a functional shape to the flotation chamber;

a valve for inflation and deflation of the tube with a gas to a predetermined pressure in the range of 100 kPa to 1000 kPa, thereby giving independent structural rigidness to the flotation chamber, the valve being integrated into the main body or within at least one of the ends of the tube; and an external mechanical means which reinforces and closes the ends of the tube, wherein the external mechanical means are clamps that have protrusions or a three dimensional design that is acted upon by the high pressure gas to independently stabilize the mechanical means against bending from the longitudinal length of the tube.

2. The inflatable flotation chamber of claim 1, wherein the mechanical means defines a point of attachment to attach the flotation chamber to the watercraft.

3. The inflatable flotation chamber of claim 1, wherein the ends of the tube are glued, welded, or fused sealed.

4. The inflatable flotation chamber of claim 1, wherein the mechanical means comprises at least one clamping plate, wherein the ends of the tube are sealed by a clamping force produced by the clamping plate.

5. The inflatable flotation chamber of claim 1, wherein the tube is made of a hose having a diameter of about 4 inch (10.16 cm) or 6 inch (15.24 cm) or 8 inch (20.32 cm) or 10 inch (25.4 cm);

wherein the tube is trimmed to a length between 10× to 40× of the dimension of the diameter of the tube.

6. The inflatable flotation chamber of claim 1, wherein the mechanical means which reinforces and closes the ends of the tube comprises at least one flange designed to give the flotation chamber a hydrodynamic shape.

7. The inflatable flotation chamber of claim 4, wherein the clamping plate comprises at least one flange that is pushed upon the tube by the pressure of the gas inside the tube, the flange is additionally designed to give the flotation chamber a better hydrodynamic shape.

8. The inflatable flotation chamber of claim 2, wherein the mechanical means comprises a plurality of connection protrusions that define the point of attachment.

9. The inflatable flotation chamber of claim 2, wherein the mechanical means comprises or connects to a structural cross member of the frame of a watercraft.

10. The inflatable flotation chamber of claim 1, wherein the mechanical means also reinforces and closes the ends of additional tubes.

11. The inflatable flotation chamber of claim 1, wherein the mechanical means comprises a crimping strip which crimps the ends of the tube, wherein the crimping strip is made of a material which is sufficiently strong and durable to maintain a clamping force.

12. The inflatable flotation chamber of claim 1, wherein the pressure of the gas inside the tube and the resultant longitudinal force at the ends of the tube are used to create a tensile force in the structural or connecting members of a floating frame or watercraft, and fix them in place.

13. A watercraft characterised by one of a multitude of inflatable chambers of claim 1.

14. The watercraft of claim 13, characterised by at least two flotation chambers and at least one crossbar, which is fixed by the clamping plate.

15. The watercraft of claim 13, characterised by at least two flotation chambers wherein the high pressure and resultant structural rigidness of the flotation chambers are used for the overall structural rigidness of the watercraft.

16. The watercraft of claim 15, characterised by one or more flexible decks; wherein the flexible deck is spread by at least two flotation chambers.

17. The watercraft of claim 15, characterised by a rigid deck board, which is attached to the flotation chamber.

18. The watercraft of claim 15, characterised by flexible wires, lines, chains, webbing, or other rigging means, which are spread by at least two flotation chambers;

wherein the flexible wires, lines, chains, webbing, or other rigging means are fixed to the clamping plate or the rigid deck board.

19. A method of constructing a high-pressure inflatable flotation chamber, characterized in having independent structural rigidity, comprising: trimming a standard fire hose or other industrial or agricultural seamless hose having a braided filament reinforcement to appropriate length, installing a valve, and sealing the ends of a tube, characterised by an external mechanical means which reinforces and closes the ends of the tube, wherein the external mechanical means are clamps that have protrusions or a three dimensional design that is acted upon by the high pressure gas to independently stabilize the mechanical means against bending from the longitudinal length of the tube.

20. The method of claim 19, wherein either the trimmed ends or mechanical means are additionally designed to give the flotation chamber a hydrodynamic shape.

* * * * *